United States Patent [19]

Arano

[11] 3,973,533

[45] Aug. 10, 1976

[54] IGNITION TIMING ADJUSTING DEVICE FOR AN INTERNAL COMBUSTION ENGINE

[75] Inventor: Isamu Arano, Katsuta, Japan

[73] Assignee: Hitachi, Ltd., Japan

[22] Filed: Dec. 9, 1974

[21] Appl. No.: 531,168

[30] Foreign Application Priority Data

Dec. 14, 1973 Japan ..... 48-138599

[52] U.S. Cl. ..... 123/117 A; 92/48; 92/63

[51] Int. Cl.[2] ..... F02P 5/04

[58] Field of Search ..... 92/48, 49, 50; 123/117 A

[56] References Cited

UNITED STATES PATENTS

| | | | |
|---|---|---|---|
| 2,596,830 | 5/1952 | Udale | 173/117 A |
| 3,521,609 | 7/1970 | Kashiwagi | 123/117 A |
| 3,656,410 | 9/1972 | Trower | 92/49 |

*Primary Examiner*—Charles J. Myhre
*Assistant Examiner*—Ronald B. Cox
*Attorney, Agent, or Firm*—Craig & Antonelli

[57] ABSTRACT

A device in which a contact base of a contact breaker is rotated about a cam shaft for effecting ignition timing adjustments for an internal combustion engine. The device comprises a negative pressure chamber defined between a first diaphragm connected to the contact base and a second diaphragm disposed in spaced juxtaposed relation with and having a larger pressure receiving area than the first diaphragm, the second diaphragm being provided with a spring which precludes diaplacement of the diaphragm till the force exerted on the diaphragm reaches a predetermined value. The negative pressure in the intake pipe of the internal combustion engine is introduced into the negative pressure chamber, so that the first diaphragm is displaced to advance ignition when the negative pressure in the negative pressure chamber is in a range of smaller values and the second diaphragm is displaced in a direction in which the first diaphragm is returned to its original position to delay ignition when the negative pressure exceeds the predetermined value.

6 Claims, 3 Drawing Figures

IGNITION TIMING ADJUSTING DEVICE FOR AN INTERNAL COMBUSTION ENGINE

This invention relates to devices for effecting ignition timing adjustments for an internal combustion engine by means of the negative pressure in the intake pipe of the engine, and more particularly it is concerned with a device whereby ignition can be advanced or delayed depending on the value of the negative pressure in the intake pipe of the internal combustion engine.

It is known that unburned hydrocarbons and carbon monoxide contained in exhaust gases emitted by an internal combustion engine increase in volume when the engine is idling or decelerating. It is also known that the concentration of these noxious elements in the exhaust gases can be reduced if there is a lag in ignition timing when the engine is under such operation conditions behind ignition timing suitable for operation of the engine under normal conditions.

Proposals have hitherto been made to employ several devices whereby ignition timing can be controlled so that ignition may be delayed when the engine is idling or decelerating. In one of such devices, the negative pressure produced anterior and posterior to the throttle valve of the caburetor is introduced into a vacuum ignition advancer which is provided separately from a vacuum ignition advancer adapted for use when the engine is under normal operation conditions, and displacement of the contact base of the contact breaker is effected by a stroke which combines displacements produced by the two ignition advancers. In another device, only one ignition advancer is employed and the negative pressure in the intake pipe is caused to selectively act on the negative pressure chamber of the ignition advancer so as to vary the amount of a displacement.

Some disadvantages are associated with such devices of the prior art. The former requires two ignition advancers and the two mechanisms should be made to be mechanically associated with the contact base of the contact breaker. This makes it necessary to increase the size of the device while difficulty is encountered in effecting control of the two mechanisms relative to each other. The latter must be provided with a changeover valve which automatically operates so as to cause the negative pressure in the intake pipe to selectively act on the ignition advancer. Because of this arrangement, the device is complex in construction.

SUMMARY OF THE INVENTION

An object of this invention is to provide a device whereby ignition advancing is automatically switched to ignition delaying depending on the value of the negative pressure in the intake pipe of an internal combustion engine which acts on a single negative pressure chamber.

Another object of the invention is to provide a device in which adjustments of the point set for switching the device from ignition advancing to ignition delaying can be readily effected.

Another object of the invention is to provide a device whereby the setting of a maximum ignition advancing value can be readily effected.

The outstanding characteristics of the invention will be summarized. The device comprises two diaphragms differing from each other in the effective pressure receiving area and defining a negative pressure chamber therebetween, one diaphragm being connected to an ignition timing signal generator while the other diaphragm being adjustable from outside. The latter diaphragm is provided with a compression spring whose brusing force is set at a desired level so that displacement of the latter diaphragm can be prevented till the negative pressure in the negative pressure chamber reaches a predetermined level.

DESCRIPTION OF THE DRAWINGS

A preferred embodiment of the invention will now be described with reference to the drawings. FIG. 1 shows the ignition timing adjusting device according to the invention as incorporated into an interrupter and FIG. 2 shows the ignition timing adjusting device in section. In FIG. 1, 1 generally designates a main body of the interrupter which is used as an ignition signal transmitter. The main body 1 of the interrupter comprises a housing 2 which houses therein a fixed base 3, a movable base 4, an interrupter contact 5 and a cam 35. The movable base 4 is supported for rotation through a predetermined amount of angle about the cam 35 relative to the fixed base 3, and is provided thereon with a fixed contact **5*a* and a movable contact 5*b* which in turn is equipped with a cam heel 6 disposed in contact relation to the outer periphery of the cam 35. The movable base 4 connects thereto one end of a rod 8 by means of a pin 7, which rod is connected at the other end to a first diaphragm 12** to be described hereinbelow.

Figure 1:
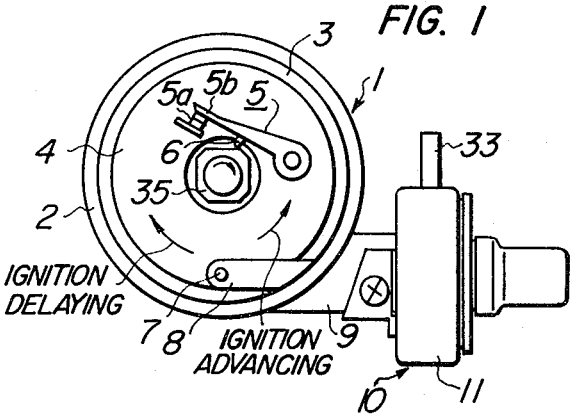
FIG. 1 is a plan view of the ignition timing adjusting device according to the invention as combined with a contact breaker.

The ignition timing adjusting device 10 is connected through a mounting plate 9 to one side of the interrupter 1. A case 11 in the form of a pan is attached to one end surface of the mounting plate 9. A first diaphragm 12 is interposed between the case 11 and a central annular member 13, while a second diaphragm 14 is interposed between the central annular member 13 and an annular case 15 disposed rightwardly of the member 13. The words "rightwardly" and "leftwardly" will designate directions in FIG. 2 unless otherwise mentioned. The case 11 is formed at its outer periphery with a flange 16 which extends to enclose the outer periphery of the central annular member 13 as shown in FIG. 1, so that the aforementioned parts are connected together as a unit.

Figure 2:
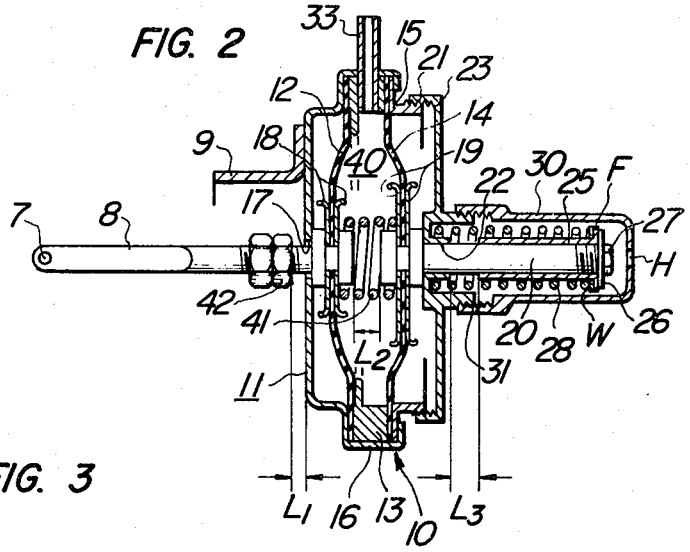
FIG. 2 is a sectional view of the ignition timing adjusting device shown in FIG. 1.

A rod 8 extends through an opening 17 formed about the central portion of the case 11 and supports at its right end, as shown in FIG. 2, the first diaphragm 12 which attaches a pair of pressure receiving discs 18 to each side thereof. The second diaphragm 14 is interposed between a pair of pressure receiving discs 29, and is connected at its central portion to a rod 20 which extends rightwardly. The right end portion of the annular case 15 is cylindrical-shaped and is threaded as at 21 at its outer periphery. A pan-shaped cover 23 is formed in its central portion with a guide opening 22 for the rod 20, and it internally threaded to threadably be fitted over the threaded portion 21 of the annular case 15, thus providing cover to the right side portion of the second diaphragm 14. Mounted on outer periphery of the rod 20 is a stopper 25 for regulating the stroke of the rod 20. The stopper 25 engages at its right end which is threaded into a right end of the rod 20 through a washer 26. A compression spring 28 which has a predetermined biasing force is mounted between a flange F formed at the right end of the stopper 25 and the cover 23. A cylindrical cover 30 is threadably connected at 31 to the cover 23 for removably enclosing the compression spring 28.

The first diaphragm 12 and the second diaphragm 14 define therebetween a negative pressure chamber 40 which is maintained in communication with the intake pipe of the engine through a conduit 33 extending through the central annular member 13, so that the negative pressure in the intake pipe will act on the negative pressure chamber 40.

A compression spring means 41 is mounted between the first diaphragm 12 and the second diaphragm 14 so as to cause the two diaphragms to be displaced outwardly to maintain the two diaphragms in positions shown in FIG. 2 when no negative pressure is at work in the negative pressure chamber 40 or when the engine is inoperative. The pressure receiving discs 18 and 19 differ from each other in diameter in that the annular member 13 is provided with an integral inner flange in contact with the first diaphragm 12 for preventing the peripheral portion of the first diaphragm 12 from deflecting rightwardly in FIG. 2 so that the first diaphragm 12 and the second diaphragm 14 may have different effective pressure receiving areas. More specifically, the force produced in the second diaphragm 14 and tending to cause the same to be displaced toward the center of the negative pressure chamber 40 is greater than the force produced in the first diaphragm 12 and tending to cause the same to be displaced toward the center of the chamber 40 when the two diaphragms 12 and 14 are exposed to the same negative pressure. A lock nut 42 is mounted on outer periphery of the rod 8 to regulate the amount of a displacement of the rod 8.

The compression spring 28 has a higher biasing force than the compression spring means 41. Thus, when the negative pressure at work in the negative pressure chamber 40 is relatively low or when the force exerted on the diaphragms 12 and 14 is relatively low, displacement of the first diaphragm 12 takes place, while the second diaphragm 14 remains substantially stationary without being displaced.

In the ignition timing adjusting device constructed as aforementioned, when the negative pressure acting on the negative pressure chamber 40 gradually becomes higher, the two diaphragms 12 and 14 remain stationary without being displaced till the negative pressure reaches a value H1, because the force exerted on the two diaphragms 12 and 14 is lower than the biasing forces of the springs 41 and 28. However, if the negative pressure becomes higher, then the force acting on the first diaphragm 12 overcomes the biasing force of the spring means 41, so that the first diaphragm 12 is displaced rightwardly and causes the rod 8 to be displaced rightwardly too. At this time a force tending to cause the second diaphragm 14 to move leftwardly is exerted thereon. However, since the second diaphragm 14 is urged to move rightwardly by the biasing force of the spring 28 through the rod 20, the second diaphragm 14 remains stationary without being displaced leftwardly. Thus it is only the first diaphragm 12 that is displaced rightwardly.

Figure 3:
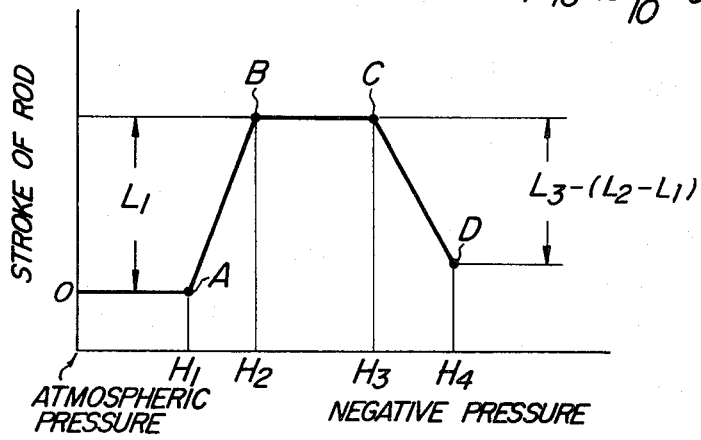
FIG. 3 is a graph showing the ignition advancing characteristics.

This can be explained by referring to the characteristics graph shown in FIG. 3. In the graph, the stroke of the rod 8 is substantially proportional to the negative pressure in the negative pressure chamber 40 as indicated by a line A-B. When the stroke of the rod 8 is equal to a distance L1, the lock nut 42 abuts at its right end against the case 11, so that further displacement of the rod 8 is precluded. Thereafter, a further increase in the negative pressure causes no changes to occur in the stroke of the rod 8. This is indicated by a line B-C in the graph.

As the negative pressure in the negative pressure chamber 40 further increases, the force exerted on the second diaphragm 14 to cause the same to move leftwardly by the negative pressure overcomes the resultant force of the force acting on the first diaphragm 12 and the biasing force of the spring 28, with a result that the second diaphragm 14 begins to be displaced leftwardly by compressing the spring 28. Thus the first diaphragm 12, which has already been displaced rightwardly, is moved back or leftwardly. This characteristic is indicated by a line C-D in FIG. 3 which represents a reduction in the stroke of the rod 8 while the negative pressure increases in value. It will be seen that, when the device according to the invention is combined with the contact breaker as shown in FIG. 1, ignition is delayed when the stroke of the rod 8 is reduced and ignition is advanced when the stroke of the rod 8 is increased.

Generally, when a motor vehicle decelerates suddenly, the negative pressure in its intake pipe markedly increases in value. A marked increase in the value of negative pressure causes the second diaphragm 14 to be displaced in the negative pressure chamber 40 and ignition is accordingly delayed, thereby making it possible to reduce the concentration of noxious elements in the exhaust emission. When the negative pressure in the intake pipe is in a relatively low range, it is possible to advance ignition in proportion to the increase in the value of negative pressure.

In the ignition timing adjusting device constructed and operating as aforementioned, it is necessary to effect adjustments of the value of the negative pressure H1 at which ignition advancing is initiated, the value of a negative pressure H3 at which ignition delaying is initiated, the amount of ignition advancing L1 and the amount of ignition delaying L3-(L2-L1) shown in FIG. 3 in accordance with the characteristics of the engine. It is inevitable that the accumulated errors of the component parts should affect these values. This makes it necessary to adjust the values to suit the specifications when the component parts have been assembled.

In view of this, means is provided according to the invention to effect adjustments of these values. First of all, the amount of ignition advancing L1 can be adjusted by varying the distance L1 between the lock nut 42 threadably fitted over the rod 8 and the side of the case 11 in FIG. 2.

When it is desired to adjust the value of the negative pressure H1 at a starting point A for ignition advancing, the end can be attained by varying the initial deflection of the spring means 41 by changing the manner in which the cover 23 is threadably mounted on the threaded portion 21 of the cover 15. That is, if the cover 23 is turned to increase the amount of threadable connection to move the cover leftwardly, the spring means 41 will be further compressed and its initial deflection can be increased. This will move the value H1 further to the right in FIG. 3.

In adjusting the value of the negative pressure H3 at a point C in FIG. 3, the initial deflection of the spring 28 is varied by mounting or dismounting washers W between the spring 28 and the flange F of the stopper 25 after removing the cover 30. That is, if the initial deflection of the spring 28 is increased, the point C will move to the right in FIG. 3.

On the other hand, when it is desired to vary the amount of a displacement of the second diaphragm 14, the end can be attained by turning the bolt 27 to vary the amount of threadable connection thereof with the rod 20 so as to thereby vary the distance L3 between the stopper 25 and the cover 30.

Thus the present invention offers the advantage of being able to readily effect adjustments of the component parts of the ignition timing adjusting device after the parts are assembled.

The cylindrical cover 30 performs the function of preventing foreign matter from invading the compression spring 28 and interfering with its operation.

In the device according to the invention, the degree of slope of the line A-B in FIG. 3 can be selected as desired by varying the spring constant of the spring means 41 and the effective pressure receiving area of the first diaphragm 12. The degree of slope of the line C-D can be selected as desired by varying the spring constant of the spring 28 and the difference between the effective pressure receiving areas of the first and second diaphragms 12 and 14.

The device according to the invention can be used in combination with a known centrifugal ignition advancer. By this arrangement, it is possible to control ignition timing more effectively.

From the foregoing description, it will be appreciated that, in the device according to the present invention, both ignition advancing characteristics and ignition delaying characteristics can be obtained by using a single negative pressure chamber, and that the values of negative pressure at the starting points of these characteristics can be adjusted as desired after the device is assembled.

Adjustments of the initial deflection of the springs can be effected while a negative pressure is acting on the negative pressure chamber. This enables adjustments to be effected accurately and precisely.

I claim:

1. An ignition timing adjusting device for an internal combustion engine wherein ignition timing of the internal combustion engine is controlled by the negative pressure in an intake pipe of the engine, comprising two diaphragms having different effective pressure receiving areas and disposed in spaced juxtaposed relation to define therebetween a negative pressure chamber, means for transmitting a displacement of the first diaphragm of the smaller effective pressure receiving area to means for producing an ignition timing signal, and limiting means connected to the second diaphragm of the larger effective pressure receiving area and disposed outwardly of the negative pressure chamber to preclude displacement of the second diaphragm till the negative pressure in the negative pressure chamber reaches a predetermined value, said first diaphragm and said second diaphragm being operatively associated with each other such that when the second diaphragm is displaced by the negative pressure in the negative pressure chamber the first diaphragm is moved back in the direction of displacement of the second diaphragm against the force tending to cause the first diaphragm to be displaced.

2. A device as claimed in claim 1 wherein displacement of said first diaphragm occurs in response to a negative pressure in the negative pressure chamber which has a value in a range of values smaller than the value of the negative pressure in the negative pressure chamber which causes the second diaphragm to be displaced, and there is provided a stopper which precludes further displacement of the first diaphragm after the displacement thereof has reached a predetermined stroke.

3. A device as claimed in claim 2 wherein said stopper for the first diaphragm is located between a rod connecting said first diaphragm to ignition timing signal producing means and a case, and the position in which the stopper operates can be adjusted as desired.

4. A device as claimed in claim 1 wherein said limiting means connected to said second diaphragm comprises a rod connected to the second diaphragm and extending outwardly from a case, a spring mounted between the case and the rod and having a biasing force which can be set at any level as desired, and means for varying the initial deflection of said spring.

5. A device as claimed in claim 4 wherein a portion of said limiting means extending outwardly of the case is covered with a detachable cover.

6. A device as claimed in claim 1 further comprising a spring means mounted between said first diaphragm and said second diaphragm, the initial deflection of said spring means capable of being adjusted from outside the negative pressure chamber by a means which forces one of the diaphragms to be displaced.

* * * * *